US007667406B2

(12) United States Patent
Trypke

(10) Patent No.: US 7,667,406 B2
(45) Date of Patent: Feb. 23, 2010

(54) ELECTRODE FOR METAL HALIDE LAMP WITH CERAMIC DISCHARGE VESSEL

(75) Inventor: Dieter Trypke, Falkensee (DE)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 672 days.

(21) Appl. No.: 11/385,899

(22) Filed: Mar. 22, 2006

(65) Prior Publication Data

US 2006/0214587 A1 Sep. 28, 2006

(30) Foreign Application Priority Data

Mar. 24, 2005 (DE) ..... 10 2005 013 899

(51) Int. Cl.
*H01J 17/16* (2006.01)
*H01J 9/00* (2006.01)

(52) U.S. Cl. ..... 313/623; 313/331; 445/26

(58) Field of Classification Search ..... 313/623, 313/634, 331, 332
See application file for complete search history.

(56) References Cited

U.S. PATENT DOCUMENTS 4,155,758 A 5/1979 Evans et al.

FOREIGN PATENT DOCUMENTS

WO WO 03/060951 7/2003

*Primary Examiner*—Joseph L Williams

(57) ABSTRACT

Metal halide lamp with ceramic discharge vessel (4), the discharge vessel having two ends (6) which are closed off by stoppers, and an electrically conductive leadthrough (9) being passed through this stopper (12), an electrode (15) having a shank (16), which projects into the interior of the discharge vessel, being secured to the leadthrough. The leadthrough is composed of two portions of different diameters, with the outer portion resting on the end face of the stopper.

5 Claims, 6 Drawing Sheets

ELECTRODE FOR METAL HALIDE LAMP WITH CERAMIC DISCHARGE VESSEL

TECHNICAL FIELD

The invention is based on a metal halide lamp with ceramic discharge vessel, the discharge vessel having two ends, which if appropriate are closed off by stoppers, and an electrically conductive leadthrough being passed through a hole in these ends, an electrode with a shank being secured to the leadthrough, which electrode projects into the interior of the discharge vessel, with the leadthrough and electrode together being referred to as the electrode system. It deals in particular with lamps with a power of from 20 to 400 W, preferably 100 to 250 W.

BACKGROUND ART

U.S. Pat. No. 4,155,758 has disclosed a metal halide lamp with ceramic discharge vessel, in which a leadthrough is provided with a portion which is widened outside the discharge vessel. The external diameter of this portion is equal to the external diameter of the discharge vessel. A sealing frit is inserted as a ring between the end of the discharge vessel and the widened portion. A discharge-side part of the pin is formed from W, while the part remote from the discharge consists of Mo. This part is completely surrounded by a filling filament which reduces the dead volume. The standard joining technique for the two electrode parts is in this case welding or brazing.

US2005029949 and corresponding WO 03/060951 have disclosed a metal halide lamp with ceramic discharge vessel, in which a leadthrough in two-part form comprises an outer Nb pin and an inner part of the same diameter. The inner part consists of $Mo_5(Si,X)_3$, where X=B, Al, N or C.

DISCLOSURE OF THE INVENTION

It is an object of the present invention to provide a metal halide lamp with a ceramic discharge vessel, said discharge vessel having two ends, which if appropriate are closed off by stoppers, and an electrically conductive leadthrough being passed through a hole in these ends, an electrode with a shank being secured to the leadthrough, which electrode projects into the interior of the discharge vessel, with the leadthrough and electrode together being referred to as the electrode system, the electrode system of which lamp is designed in such a way as to simplify production as much as possible.

This object is achieved by the following features:

The leadthrough comprises two portions, which are designed as cylindrical pins of different diameters, the portion which lies on the inside with respect to the discharge having an external diameter which is at least 10 μm smaller than the diameter of the hole, and the portion which lies on the outside having a diameter which is slightly larger, in particular 5 to 20 μm larger, than the diameter of the hole, with the step between the two portions serving as a stop for the leadthrough at the end face of the capillary.

Particularly advantageous configurations are given in the dependent claims.

In detail, the invention relates to a metal halide lamp with a ceramic discharge vessel, the discharge vessel having two ends, which if appropriate are closed off by stoppers, and an electrically conductive leadthrough being passed through a hole in these ends, an electrode with a shank being secured to the leadthrough, which electrode projects into the interior of the discharge vessel, with the leadthrough and electrode together being referred to as the electrode system, characterized in that the leadthrough comprises two portions, which are designed as cylindrical pins of different diameters, the portion which lies on the inside with respect to the discharge having an external diameter which is at least 10 μm smaller than the diameter of the hole, and the portion which lies on the outside having a diameter which is slightly larger, in particular 5 to 20 μm larger, than the diameter of the hole. The step between the two portions serves as a stop for the leadthrough at the end face of the capillary.

The material of the leadthrough may be a sintered body which is produced directly as a shaped part. Alternatively, the step can be subsequently machined out of a pin that was previously of uniform configuration.

The ends are typically designed as capillaries, which are attached to the discharge vessel either integrally or by means of separate stoppers. The discharge vessel typically consists of $Al_2O_3$, optionally doped with standard additives, for example Mg.

The invention is particularly effective if the lamp power is in the range from 20 to 400 W, in particular 100 to 250 W.

In particular, the leadthrough may consist of one material in single-part form. This is advantageously a material which predominantly comprises molybdenum. One such example is MoV or $Mo_5(Si,X)_3$, where X=B, Al, N or C, as is known per se. Standard systems are multicomponent systems in which the individual tolerances are cumulative. Typical problems in this case are bending of the individual parts, axial offset, thickening of the diameter (growth) at the location of the join and further shape and position tolerances.

Another embodiment is characterized in that the two portions consist of different materials, with in particular the inner portion predominantly comprising cermet or molybdenum, while the outer portion includes niobium or niobium-like material. As is known per se, the inner part may be an Mo pin or an Mo pin with surrounding filament component or a cermet pin, which is mechanically secured in a leadthrough hole. Cermet pins themselves are already known, for example, from EP-A 887 839.

The coordination between inner and outer portions of the leadthrough which has now been discovered allows a standard soldering-glass ring to be used in manufacture, with this ring bearing securely against the end of the discharge vessel and ensuring sufficient volume for sealing both in the capillary and outside on the outer portion. If the diameter of the outer portion were selected to be greater, there would be a risk of the soldering glass no longer flowing sufficiently to provide a reliable seal between the contact surface of the leadthrough and the end face of the capillary, and in particular being unable to penetrate to a sufficient extent into the capillary. This advantage which is now produced is achieved irrespective of whether the leadthrough is of single-part or two-part configuration. Nonetheless, a single-part configuration offers very particular benefits, since it can be produced from a single material, in which case, on account of the small difference between the two portions, only a small amount of material has to be milled off the original pin of fixed, larger diameter in order to produce the inner portion. The milling can be carried out mechanically or by means of a laser.

The outer portion then bears flat against the end face of the end of the capillary, with an ultrathin layer of the soldering glass still present between them. This creates a well-defined penetration depth of the electrodes secured to the leadthrough into the discharge volume. On the other hand, in the case of a two-part leadthrough, increased scatter in the depth of penetration is observed, on account of the tolerances in joining the two components of the leadthrough. Now, the overall result is a much better defined distance between the electrodes, since the effect is cumulative at both ends. It is in this case not sufficient at all to use just a single-part leadthrough which does not have a stop, since free positioning without a stop always causes a considerably greater tolerance in the penetration depth of the electrode.

The invention also relates to a process for producing a ceramic discharge vessel (often referred to in this context as a burner), comprising the following steps:

a) providing a discharge vessel which has an open capillary;

b) providing an electrode system which has a leadthrough comprising two portions of different diameters, the portion which lies on the inside with respect to the discharge having an external diameter which is at least 10 μm smaller than the diameter of the hole, and the portion which lies on the outside having a diameter which is slightly larger, in particular 5 to 20 μm larger, than the diameter of the hole;

c) pushing a ring of soldering glass onto the narrower portion of the electrode system, in which case the wider portion serves as a stop;

d) introducing the electrode system into the capillary hole, with the soldering-glass ring resting on the end of the capillary;

e) heating the soldering-glass ring, so that some of the soldering glass runs into the capillary, thereby effecting sealing.

Particularly if a single-piece leadthrough is used, the invention makes it possible to reduce the dead volume in the capillary and allows simplified production of the electrode system. The dead volume DV in the capillary is given by DV=capillary volume minus capillary leadthrough volume (volume of that part of the electrode system which is located in the capillary) minus volume of the sealing length of the soldering glass. The dimensions of the leadthrough are now such that all the tolerance presets of the individual components (capillary, electrode system) and of the manufacturing process (shape and position tolerances) can no longer lead to production standstills, which previously led to the dead volume having a high degree of scatter. Some of the burner fill is deposited irreversibly, as a function of the lamp operating position, in this dead volume between capillary and electrode systems. The burner fill quantity (metal halide) therefore hitherto had to be selected as a compromise which still gave usable results for the individual lamp within the wide tolerance for the dead volume. In this case, sufficient fill quantity must be present in the discharge vessel to guarantee the color locus and stability throughout the illumination life of the lamp and to keep the color temperature scatter within specifications. At the same time, it is necessary not to add too much fill quantity, since this leads to different and serious service life problems. The restarting peak voltage also rises with an increase in fill quantity, which in turn can lead to premature extinguishing of the lamps. The dependence on the operating positioning i.e. the color temperature difference according to operating position, increases.

A greater fill quantity can lead to greater erosion at the ceramic wall (premature failures caused by the escape of fill).

With a small dead volume, conversely, sufficient fill quantity can remain in the burner for it to form a shadow on the illuminated object.

Therefore, color temperature differences have hitherto occurred from production batch to production batch, on account of a varying fill quantity remaining in the burner. All these drawbacks are now avoided, on account of the considerably lower manufacturing tolerance for the dead volume.

The invention also makes it possible to reduce the capillary length if a single-part leadthrough is used. As the temperature rises, the different coefficients of thermal expansion of pure molybdenum and of $Al_2O_3$ (material of the discharge vessel) causes the risk of cracks in the sealing region to increase, and consequently hitherto capillary lengths that are as long as possible have been used, in order to keep the temperature in the sealing region at a low level.

Even if a two-part leadthrough with an inner molybdenum component, such as a molybdenum sintered material and an outer niobium pin (if appropriate an Nb—Zr pin can be used) is used, it has hitherto been necessary to take account of the different expansion coefficients of these materials. The capillary length then has to be dimensioned in such a way as to minimize the risk of cracks forming. The in particular single-part leadthrough provides the option of shortening the capillary length by using a suitable molybdenum material uniformly. It is in this way possible to provide more compact ceramic metal halide lamps. Alternatively, the lamp production can be made more reliable where lamp engineering is already reaching its limits on account of the overall length of the discharge vessel, in particular in the case of low-wattage, extremely compact lamps. In addition, this further reduces the dead volume in the capillary. A further saving on fill quantity is thus possible.

The use of a molybdenum sintered material is preferred, because its coefficient of thermal expansion is almost equal or at least similar to that of $Al_2O_3$.

The invention makes it possible to reduce the depth of manufacture in constructing the electrode system, since fewer winding, cutting and welding devices are required, and in burner manufacture, since preparation of the electrode system is simplified. It also allows the use of cost-saving preliminary materials in construction of the lamp frame, since if appropriate it is possible to dispense with the use of expensive niobium material.

Moreover, a single-part electrode system allows the tolerances of the individual components (ceramic as electrode system) to be minimized. Moreover, further problems with shape and position tolerances arising from the manufacturing process are eliminated.

Therefore, the leadthrough preferably comprises just one component. This may in particular be a cermet component. Other materials which have a similar expansion coefficient to the burner ceramic made from $Al_2O_3$ and are electrically conductive are also suitable.

The stop between the inner and outer portions of the leadthrough fixes the electrode system in the burner and thereby produces an unambiguous electrode gap.

The diameter of the inner portion, which is located inside the capillary, can be restricted to a dimensional scatter of approximately ±10 μm. This gives the possibility of finding a combination of capillary diameter to capillary leadthrough which reduces the dead volume in the burner capillary by up to 90%. The reduction in the dead volume in the capillary allows the use of a smaller burner fill quantity. This in turn has the advantage of reducing the color temperature scatter, restarting peak voltage and erosion.

Manufacture of a system of this type is simplified considerably. Only one weld is required, between the tungsten electrode and the leadthrough. Alternatively, this join may also be made as a plug connection (press fit), and/or the tungsten electrode can be sintered directly into the leadthrough if the latter is designed as a cermet.

Handling of the electrode system is simplified. The risk of the electrode system bending, as occurs with flexible components consisting for example of molybdenum and niobium, is avoided as a result. The single-part leadthrough allows a rigid leadthrough or electrode system.

If materials other than niobium are used for the lamp frame structure, it is usually necessary to use welding aids to ensure a permanent join between burner and frame. By contrast, it is now possible to make use of less expensive materials. There is no need for a vacuum in the outer bulb if an alternative to the niobium frame can be used.

BRIEF DESCRIPTION OF THE DRAWINGS

In the text which follows, the invention is to be explained in more detail on the basis of a number of exemplary embodiments. In the drawing.

BEST MODE FOR CARRYING OUT THE INVENTION

Figure 1:
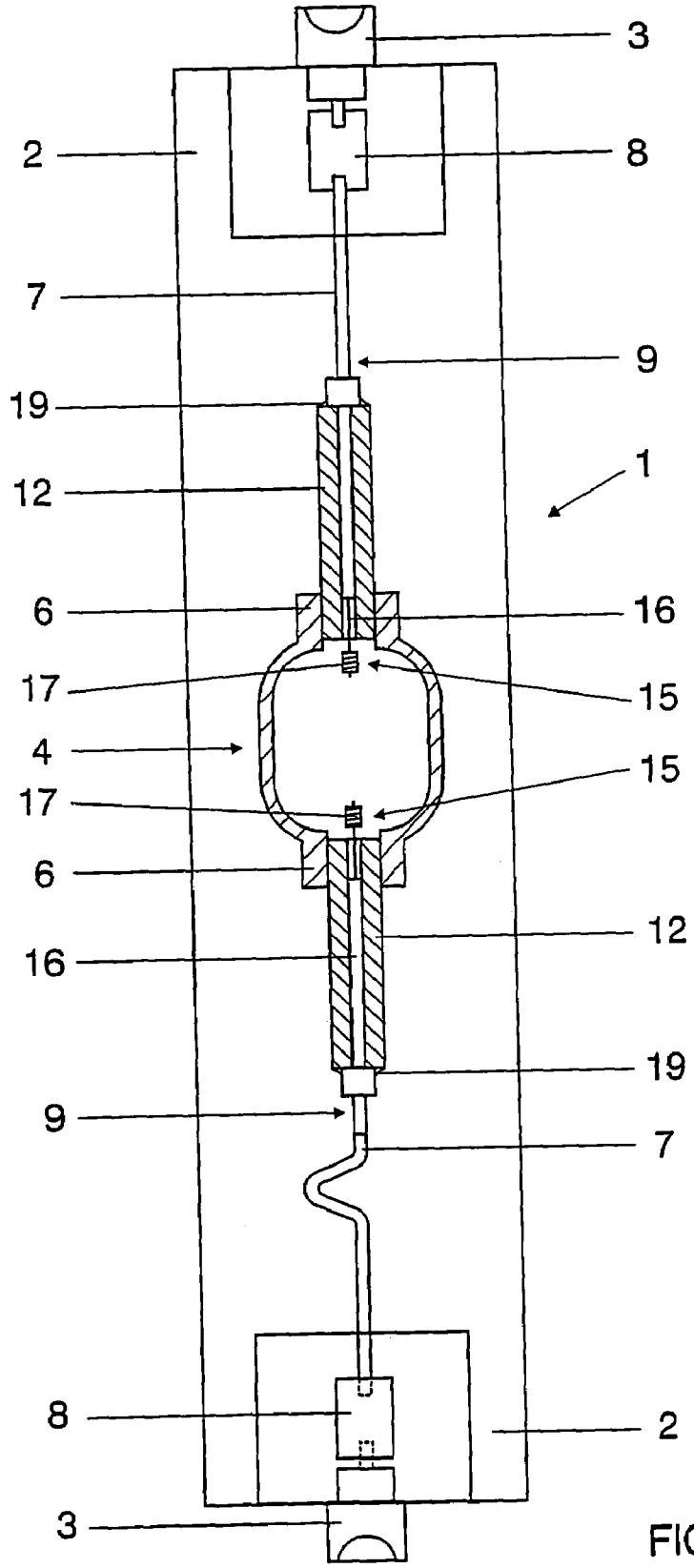
FIG. 1 diagrammatically depicts a metal halide lamp with ceramic discharge vessel.

FIG. 1 diagrammatically depicts a metal halide lamp with a power of 150 W. It comprises a cylindrical outer bulb 1 which defines a lamp axis, is made from quartz glass and is pinched (2) and capped (3) on two sides. Of course, the lamp may also be closed on one side and provided, for example with a screw cap. The axially arranged discharge vessel 4 made from $Al_2O_3$ ceramic is cylindrical or convex in shape and has two ends 6. It is held in the outer bulb 1 by means of two supply conductors 7, which are connected to the cap parts 3 via foils 8. The supply conductors 7 are welded to leadthroughs 9, which are each fitted in an end stopper at the end 6 of the discharge vessel. The end stopper is designed as an elongate capillary tube 12 (stopper capillary). The end 6 of the discharge vessel and the stopper capillary 12 are, for example, directly sintered to one another or are also formed integrally on one another in single-piece form, cf. FIG. 2. An electrode 15 is positioned on the discharge side of the leadthrough 9. This electrode can be welded or simply held by plug connection.

The leadthrough 9 projects into the capillary tube 12 over between one quarter and 90% of the length of said capillary tube. This is followed within the capillary tube 12, in the direction of the discharge volume, by an extended electrode shank 16 made from tungsten with, for example, a filament 17 pushed onto the discharge-side end of the shank. The diameter of the hole in the capillary is approximately 950 μm, and the diameter of the inner portion of the leadthrough is approximately 840 μm.

In addition to an inert firing gas, for example argon, the fill of the discharge vessel consists of mercury and additions of metal halides. By way of example, it is also possible to use a metal halide fill without mercury, in which case the firing gas selected may preferably be xenon, and in particular with a high pressure, well over 1.3 bar.

The leadthrough is sealed by means of soldering glass 19. In this context, it is important for the soldering glass to extend into the capillary over part of the length of the latter, as can be seen more clearly in FIG. 2.

Figure 2:
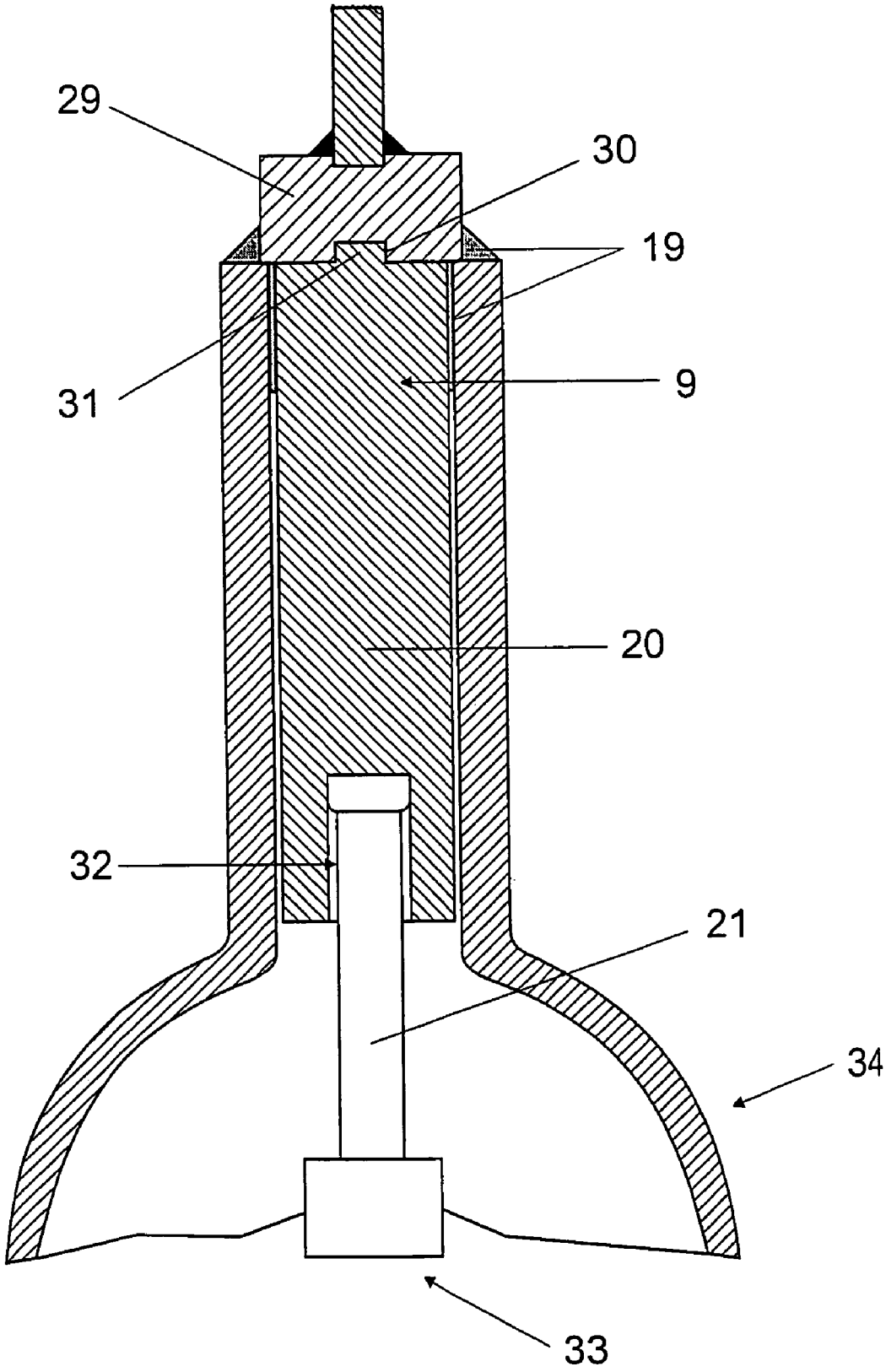
FIG. 2 diagrammatically depicts a detail of the end region of the lamp from FIG. 1.

FIG. 2 shows an electrode system for a 35 W lamp 34 in detail in the capillary, which is in this case selected to be integral. The leadthrough 9 is composed of two parts. A niobium pin with a diameter of 0.61 mm is used as the outer portion 29. An Mo pin 20 with a diameter of approximately 0.56 mm is fitted onto the outer portion 29, and its projecting peg 31 is pressed into a hole 30 in the niobium pin 29. The diameter of the capillary is 0.65 mm. The Mo pin 20 has a hole 32 which accommodates the W pin 21 that serves as the electrode shank. The Mo pin 20 holds the W pin 21 of the electrode 33 purely mechanically by means of a press fit.

Figure 3A:
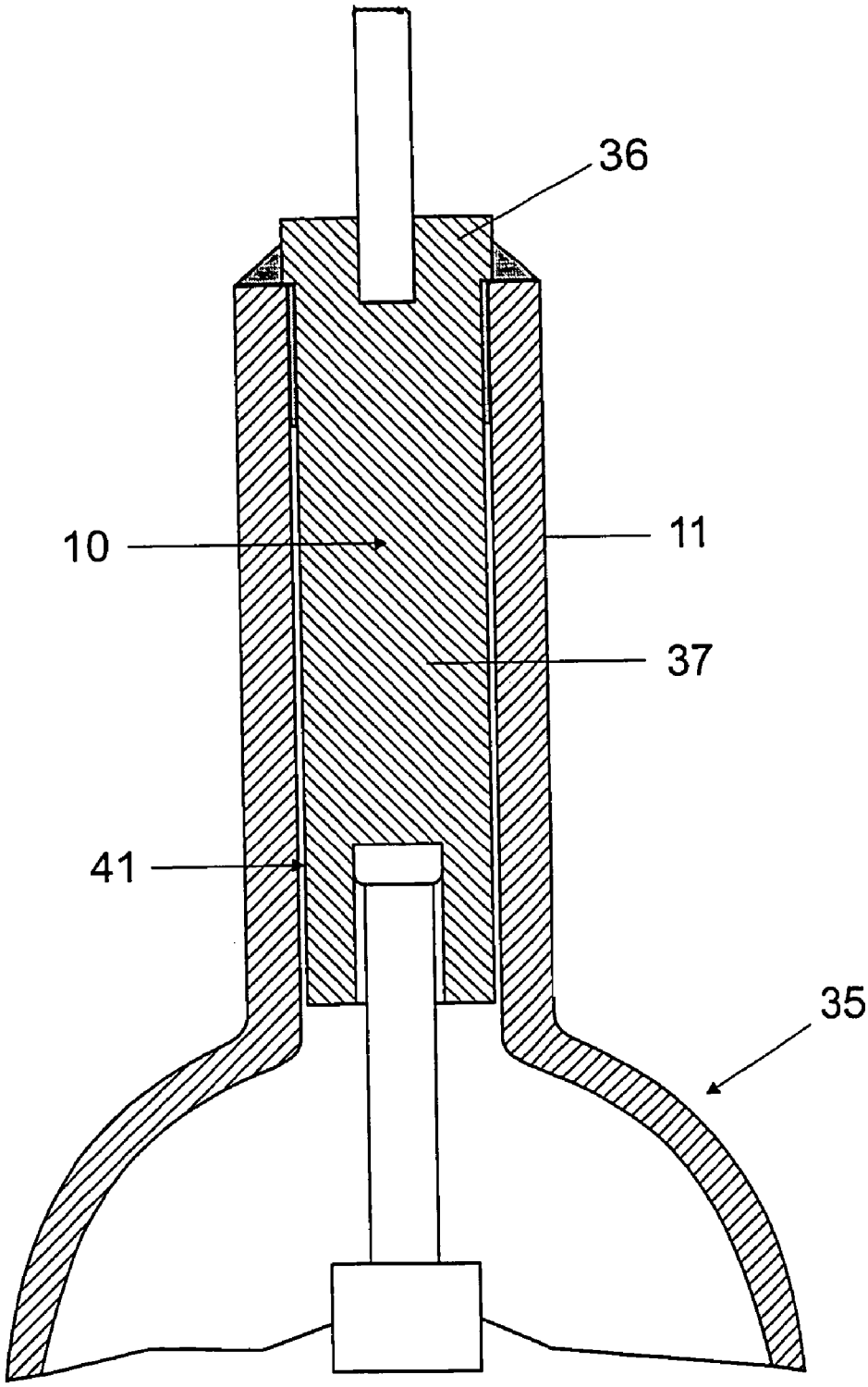
FIG. 3 diagrammatically depicts another exemplary embodiment of an electrode system.
Figure 3B:
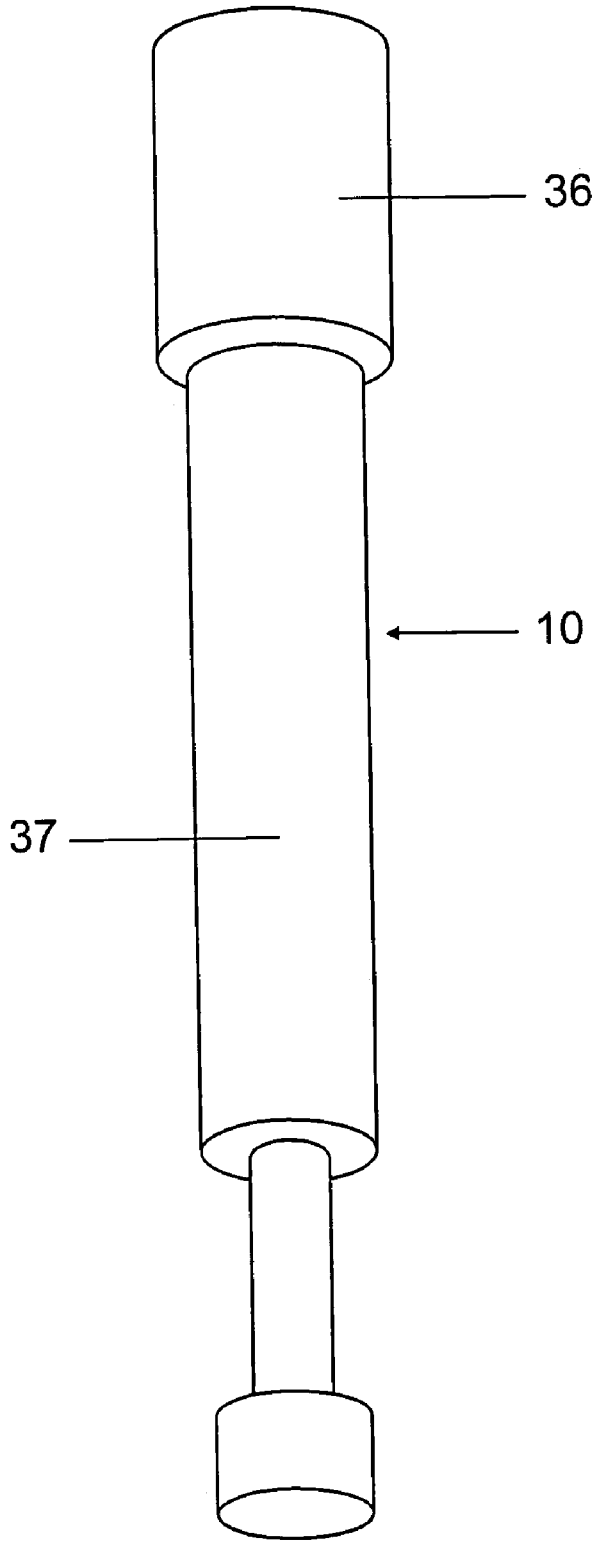

FIG. 3 shows a further exemplary embodiment of an electrode system for a 70 W lamp 35, to be precise, in section (FIG. 3*a*) and in perspective view (FIG. 3*b*). The leadthrough 10 used is a single-part pin with an original diameter of 0.87 mm. The diameter of the hole 41 in the capillary 11 is 0.85 mm. The diameter of the outer portion 36 of the pin 10 corresponds to the original diameter of the pin, which is made from Mo5Si2B. The inner portion 37, which is rectilinearly stepped, has been milled down to 0.79 mm, so that a minimal dead volume remains in the hole 41 filled by the leadthrough.

Figure 4:
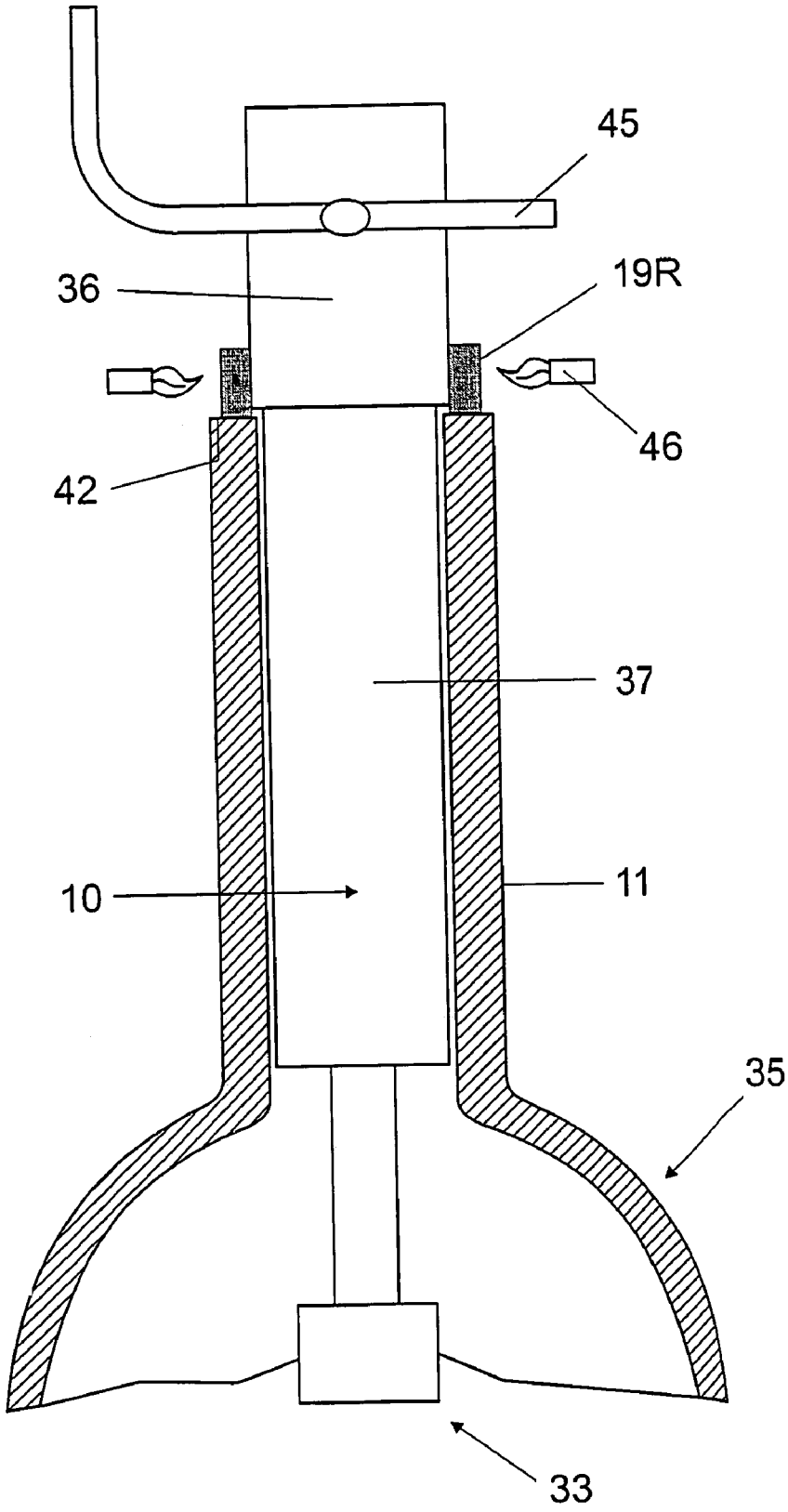
FIG. 4 diagrammatically depicts an exemplary embodiment of a method for the closing of an end region.

The closing of the discharge vessel can now take place by firstly providing a discharge vessel 35, if appropriate with stopper or—as illustrated in FIG. 4—with integral capillary 11, this discharge vessel standing vertically. Furthermore, an electrode system with stepped leadthrough 10 and electrode 33 attached to it is provided. A suitably selected ring 19R of soldering glass is placed onto the end 42 of the upper capillary 11, the internal diameter of the ring 19R being selected to be slightly larger than the diameter of the outer portion 36 (FIG. 4). The leadthrough 10 is first of all held at a slight distance but already within the soldering-glass ring (45), until the soldering glass 19R is heated and liquefied by means of heating source 46, for example a gas burner or laser, and has penetrated into the hole of the capillary 11. Preferred alternatives as heating sources are radiofrequency melting devices and melting devices using an externally fitted heating coil. On account of capillary forces, the soldering glass flows between the electrode system and the inner wall of the capillary and thereby fills the upper part of the dead volume. Then, the leadthrough is released, with a thin film of the soldering glass remaining between the two parts. Moreover, an amount of soldering glass also remains on the outside of the outer portion of the leadthrough, so that the soldering glass can have a sealing action at a total of three locations: in the capillary, on the end face and on the outside of the outer portion of the leadthrough, as illustrated in FIG. 3*a*. In addition to a single-part capillary lead through with holes for a W electrode and for the outer supply conductor, it is of course also possible to use a leadthrough of this type without holes. In this case, the electrode and/or the supply conductor are butt-welded onto the respective end of the leadthrough.

Figure 5:
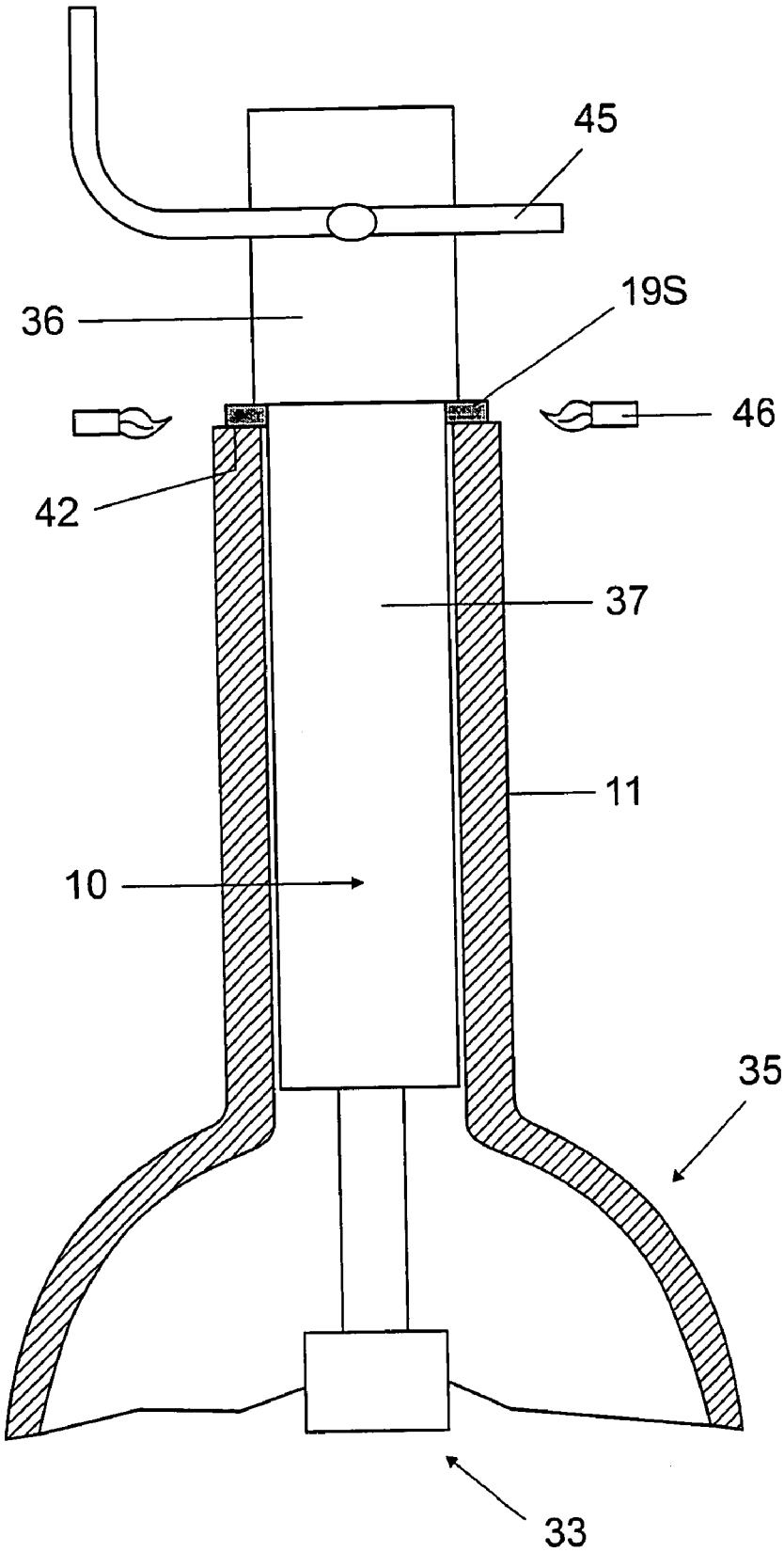
FIG. 5 diagrammatically depicts another exemplary embodiment of a method for the closing of an end region.

In another variant of the closing according to FIG. 5, a specific soldering-glass ring 19S is used which is narrow in terms of its height but thick in terms of its width. This soldering-glass ring 19S is pushed over the diameter of the inner portion 37, with the projecting part of the outer portion 36 serving as a stop. This assembly is inserted into the capillary, with the soldering-glass ring 19S once again bearing against the end face 42 of the capillary, but in this case doing so alone. The electrode system can drop onto the end face under the force of gravity after removal of the holder 45 through heating and melting of the soldering-glass ring, it being possible to control the depth to which it drops by the time at which it is released, if desired.

What is claimed is:

1. A metal halide lamp comprising:

a ceramic discharge vessel defining an enclosed interior volume, the discharge vessel having at least one end defining a hole extending to the enclosed interior volume, and an electrically conductive leadthrough being passed through the defined hole in the at least one end, an electrode with a shank being secured to the leadthrough, which electrode projects into the interior volume of the discharge vessel, with the leadthrough and electrode together being referred to as the electrode system, wherein the leadthrough comprises two axially sequential portions, the first portion being an axially extending pin, being relatively closer to the interior volume, and the second portion being relatively farther from the interior volume, the first portion extending in the defined hole, and the second section having at least one axially transverse dimension greater than a corresponding axially transverse dimension of the defined hole so as block insertion of the second section into the defined hole.

2. The metal halide lamp as claimed in claim 1, wherein the leadthrough consists of one material in single-part form.

3. The metal halide lamp as claimed in claim 2, wherein the material predominantly comprises molybdenum.

4. The metal halide lamp as claimed in claim 1, wherein the first portion predominantly comprising cermet or molybdenum, while the second portion includes niobium or niobium-like material.

5. A process for producing a ceramic discharge vessel, comprising the following steps:

a) providing a discharge vessel which has an open capillary;

b) providing an electrode system which has a leadthrough comprising two portions of different diameters, the portion which lies on the inside with respect to the discharge having an external diameter which is at least 10 μm smaller than the diameter of the hole, and the portion which lies on the outside having a diameter which is at least 5 μm larger than the diameter of the hole;

c) either pushing a ring of soldering glass onto the narrower portion of the electrode system, in which case the wider portion serves as a stop; or placing a soldering-glass ring directly onto the upper end face of the capillary;

d) introducing the electrode system into the capillary hole, with the soldering-glass ring resting on the end face of the capillary;

e) heating the soldering-glass ring, so that some of the soldering glass runs into the capillary, thereby effecting sealing.

* * * * *